US007938919B2

(12) United States Patent
Nazmy et al.

(10) Patent No.: US 7,938,919 B2
(45) Date of Patent: May 10, 2011

(54) METHOD FOR THE HEAT TREATMENT OF NICKEL-BASED SUPERALLOYS

(75) Inventors: Mohamed Youssef Nazmy, Fislisbach (CH); Markus Staubli, Dottikon (CH); Andreas Kuenzler, Baden (CH)

(73) Assignee: Alstom Technology Ltd, Baden (CH)

( * ) Notice: Subject to any disclaimer, the term of this patent is extended or adjusted under 35 U.S.C. 154(b) by 749 days.

(21) Appl. No.: 11/851,749

(22) Filed: Sep. 7, 2007

(65) Prior Publication Data

US 2008/0112814 A1 May 15, 2008

(30) Foreign Application Priority Data

Sep. 7, 2006 (CH) ..... 1434/06

(51) Int. Cl.
*C22F 1/10* (2006.01)
*F01D 5/14* (2006.01)
*C22C 19/05* (2006.01)

(52) U.S. Cl. ..... 148/675; 416/241 R; 420/447

(58) Field of Classification Search ..... 148/675; 416/241 R; 420/447
See application file for complete search history.

(56) References Cited

U.S. PATENT DOCUMENTS

| | | | | |
|---|---|---|---|---|
| 4,643,782 | A | 2/1987 | Harris et al. | |
| 5,173,255 | A * | 12/1992 | Ross et al. | 420/445 |
| 5,270,123 | A | 12/1993 | Walston et al. | |
| 5,399,313 | A | 3/1995 | Ross et al. | |
| 5,435,861 | A | 7/1995 | Khan et al. | |
| 5,882,446 | A | 3/1999 | Konter et al. | |
| 2004/0055669 | A1 | 3/2004 | Gell et al. | |

FOREIGN PATENT DOCUMENTS

| | | |
|---|---|---|
| DE | 1964047 | 2/1971 |
| DE | 19617093 | 10/1997 |
| EP | 0155827 | 9/1985 |
| EP | 0208645 | 1/1987 |
| EP | 0362661 | 4/1990 |
| GB | 2152076 | 7/1985 |
| GB | 2234521 | 2/1991 |
| GB | 2235697 | 3/1991 |
| WO | 2004038056 | 5/2004 |

OTHER PUBLICATIONS

Jung-Chel Chang et al. "Development of Microstructure and Mechanical Properties of a Ni-Base Single-Crystal Superalloy by Hot-Isostatic Pressing", Journal of Materials Engineering and Performance, ASM International, Materials Park, OH, US, vol. 12, Aug. 2003, pp. 420-425, XP-001169993.

* cited by examiner

*Primary Examiner* — Roy King
*Assistant Examiner* — Jessee R. Roe
(74) *Attorney, Agent, or Firm* — Leydig, Voit & Mayer, Ltd.

(57) ABSTRACT

A heat treatment method for a nickel-based superalloy, in particular for the production of single-crystal components or directionally solidified components having a chemical composition permits full solution annealing at a temperature T1, the method comprising: partially solution annealing in a controlled manner at a temperature T2<T1 in a first step so as to obtain 5-10% of undissolved γ' phase in a residual eutectic; and performing a two-stage ageing treatment at respectively lower temperatures in a second step. As a function of the selected level of the partial solution annealing temperature, the proportion of the undissolved γ' phase can be adjusted in a controlled way, and the tolerance with respect to the disorientation of small-angle grain boundaries/grain boundaries can be increased.

1 Claim, 5 Drawing Sheets

METHOD FOR THE HEAT TREATMENT OF NICKEL-BASED SUPERALLOYS

Priority is claimed to Swiss Patent Application No. CH 01434/06, filed on Sep. 7, 2006, the entire disclosure of which is incorporated by reference herein.

The present invention relates generally to the field of materials science and specifically to a method for the heat treatment of nickel-based superalloys which per se can be fully heat treated (solution annealed) and are used for the production of single-crystal components (SX alloy) or components with a directionally solidified structure (DS alloy), for example blades for gas turbines. The properties of said alloys, particularly at high temperatures, are intended to be influenced positively by the heat treatment method according to the invention by increasing the permissible tolerance with respect to small-angle grain boundaries and the casting yield, and therefore the effectiveness of the casting.

BACKGROUND

Nickel-based superalloys are known. At high temperatures, single-crystal components made of these alloys have inter alia a very good material strength but also good corrosion and oxidation resistance, as well as a good creep strength. Owing to these properties, when using such materials for example in gas turbines, the intake temperature of the gas turbines can be raised so that the efficiency of the gas turbine system increases.

Simply speaking, there are two types of single-crystal nickel-based superalloys.

The first type, to which the present invention also relates, can be fully heat treated (solution annealed) so that the entire γ' phase lies in solution. This is for example the case for the known alloy CMSX4 with the following chemical composition (data in wt. %): 5.6 Al, 9.0 Co, 6.5 Cr, 0.1 Hf, 0.6 Mo, 3 Re, 6.5 Ta, 1.0 Ti, 6.0 W, remainder Ni or the alloy PWA 1484 with the following chemical composition (data in wt. %): 5 Cr, 10 Co, 6 W, 2 Mo, 3 Re, 8.7 Ta, 5.6 Al, 0.1 Hf and the known alloy MC2 which, in contrast to the previously mentioned alloys, is not alloyed with rhenium and has the following chemical composition (data in wt. %): 5 Co, 8 Cr, 2 Mo, 8 W, 5 Al, 1.5 Ti, 6 Ta, remainder Ni.

A typical standard heat treatment for CMSX4 is for example as follows: solution annealing at 1320° C./2 h/shield gas, rapid cooling with a blower.

The second type of single-crystal nickel-based alloys is not fully heat treatable, i.e. in this case the entire proportion of the γ' phase does not enter solution during solution annealing, rather only a certain part of it does. This is for example the case for the known superalloy CMSX186 with the following chemical composition (data in wt. %): 0.07 C, 6 Cr, 9 Co, 0.5 Mo, 8 W, 3 Ta, 3 Re, 5.7 Al, 0.7 Ti, 1.4 Hf, 0.015 B, 0.005 Zr, remainder Ni and the alloy CMSX486 with the following chemical composition (data in wt. %): 0.07 C, 0.015 B, 5.7 Al, 9.3 Co, 5 Cr, 1.2 Hf, 0.7 Mo, 3 Re, 4.5 Ta, 0.7 Ti, 8.6 W, 0.005 Zr, remainder Ni.

The nickel-based superalloys of the second type are usually exposed to a two-stage heat treatment (ageing process at lower temperatures) since at high temperatures, such as are typically used for solution annealing the alloys of the first type, the melting point initiation temperature is already reached and the alloy therefore undesirably begins to melt.

A typical two-stage heat treatment of the alloy CMSX186 is for example as follows:

$1^{st}$ stage: 1080° C./4 h/blower $2^{nd}$ stage: 870° C./20 h/blower

The creep strength of the first type of nickel-based superalloys is normally higher than that of the second type, assuming that the alloys belong to the same generation. This is primarily due to the fact that the dissolved γ' is the main source of the achievable strength.

Nickel-based superalloys for single-crystal components, such as are known from U.S. Pat. No. 4,643,782, EP 0 208 645 and U.S. Pat. No. 5,270,123, contain mixed-crystal strengthening alloy elements, for example Re, W, Mo, Co, Cr, and γ' phase-forming elements, for example Al, Ta and Ti. The content of high-melting alloy elements (W, Mo, Re) in the basic matrix (austenitic γ phase) increases continuously with the rise in the working temperature. Thus, for example, conventional nickel-based superalloys for single crystals contain 6-8% W, up to 6% Re and up to 2% Mo (data in wt. %). The alloys disclosed in the documents cited above have a high creep strength, and good LCF (Low Cycle Fatigue) and HCF (High Cycle Fatigue) properties as well as a high oxidation resistance.

These known alloys were developed for aircraft turbines and therefore optimized for short- and medium-term use, i.e. the working time is configured for up to 20,000 hours. In contrast to this, industrial gas turbine components must be configured for a working time of up to 75,000 hours or even more.

After a working time of 300 hours during experimental use in a gas turbine at a temperature above 1000° C., for example, the alloy CMSX-4 of U.S. Pat. No. 4,643,782 shows a large growth of the γ' phase which is detrimentally associated with an increase in the creep strength of the alloy.

Another problem with the known nickel-based superalloys, for example the alloys known from U.S. Pat. No. 5,435,861, is that the castability for large components, for example in gas turbine blades with a length of more than 80 mm, leaves much to be desired. It is extremely difficult to cast a perfect, relatively large directionally solidified single-crystal component from a nickel-based superalloy because most of these components comprise defects, for example small-angle grain boundaries, "freckles" i.e. defects due to a series of co-oriented grains with a high eutectic content, axial variations, microporosities etc. These defects weaken the components at high temperatures, so that the desired lifetime or operating temperature of the turbine is not achieved. But since a perfectly cast single-crystal component is extremely expensive, the industry tends to allow as many defects as possible without compromising the lifetime or operating temperature.

Some of the most frequent defects are grain boundaries, which are particularly detrimental to the high-temperature properties of the single-crystal articles. While small-angle grain boundaries have only a comparatively minor effect on the properties for small components, they are of great relevance for the castability and the oxidation behavior at high temperatures in the case of large SX or DS components.

Grain boundaries are regions of high local disorder in the crystal lattice since the neighboring grains meet in these regions and there is therefore a certain disorientation between the crystal lattices. The greater this disorientation is, the greater is the disorder i.e. the greater is the number of dislocations in the grain boundaries which are needed so that the two grains fit together. This disorder is in direct correlation with the behavior of the material at high temperatures. It weakens the material when the temperature is increased above the equicohesive temperature (=0.5×melting point in K).

This effect is known from GB 2 234 521 A. At a testing temperature of 871° C. for a conventional nickel-based single-crystal alloy, for example, the breaking strength decreases greatly when the disorientation of the grains is more than 6°. This has also been found for single-crystal components with a directionally solidified structure, so the opinion has generally been accepted that disorientations of more than 6° are not permissible.

The tolerance with respect to a deviation in the small-angle grain boundaries, or grain boundary disorientation, is generally greater for the second type of nickel-based superalloys than for those which are not fully heat treatable.

It is also known from the cited GB 2 234 521 A that enriching nickel-based superalloys with boron or carbon in the case of directional solidification generates structures which have an equiaxial or prismatic grain structure. Carbon and boron strengthen the grain boundaries since C and B cause the precipitation of carbides and borides, which are stable at high temperatures, on the grain boundaries. The presence of these elements in the grain boundaries and along the grain boundaries furthermore reduces the diffusion process, which is a main cause of the grain boundary weakness. It is therefore possible to increase the disorientations to as much as 10° to 12°, and nevertheless achieve good properties of the material at high temperatures.

Particularly for large single-crystal components made of nickel-based superalloys, however, these small-angle grain boundaries detrimentally affect the properties. Furthermore, microalloying with B and C is limited to a few hundred ppm C and only a few ppm B, since said elements on the one hand have only a low solubility in the matrix and on the other hand have a strong effect on the undesired reduction of the initial melting point of this alloy.

Heat treatment methods for nickel-based superalloys are known from US 2004/0055669 A1, EP 0 155 827 A2, WO 2004/038056 A1 and DE 196 17 093 A1, in which the alloy is only partially solution annealed in a first heat treatment step and a two-stage ageing treatment known per se is carried out at respectively lower temperatures in a second step.

SUMMARY OF THE INVENTION

An object of the present invention is to avoid one or more disadvantages of the prior art. It is an object of the invention to provide a suitable method for the heat treatment of those known nickel-based superalloys which have a chemical composition that readily permits full solution annealing (annealing to dissolve precipitated constituents) and which are used for the production of single-crystal components (SX alloy) or components with a directionally solidified structure (DS alloy). The properties of said alloys, particularly at high temperatures, are intended to be further influenced positively by the heat treatment method according to the invention. In particular, the permissible tolerance with respect to small-angle grain boundaries or grain boundary disorientation is intended to be increased, so that the casting yield and therefore the effectiveness of the casting are increased.

The present invention provides a heat treatment method, in which the nickel-based superalloy is subjected to a multistage heat treatment method, where in a first step the alloy is only partially solution annealed in a controlled way at a temperature $T2<T1$, and in a second step a two-stage ageing treatment is carried out each at lower temperatures. Expediently, 5-10% of undissolved γ' phase should be obtained in the residual eutectic in the described first step (partial solution annealing), this being dependent on the level of the respective temperature during the partial solution annealing heat treatment.

This has the advantage that the strength of the small-angle grain boundaries or grain boundaries is raised by the undissolved γ/γ' residual eutectic and their tolerance with respect to disorientation therefore increases to>12°, depending on the material composition used. The consequence of this high tolerance with respect to small-angle grain boundaries/grain boundaries is a high casting yield for large cast components, for example single-crystal rotor blades or single-crystal guide vanes of turbine heat engines. A high casting yield advantageously leads to an increase in effectiveness without additional outlay.

The calculated increase in the undissolved γ' phase in the residual eutectic may in this case be controlled as a function of the level of the solution annealing temperature. Since most of the SX nickel-based superalloys that are used in industrial gas turbines have a high creep strength (endurance), a certain reduction in this creep strength can be accepted in order to achieve a high tolerance with respect to the disorientation of the small-angle grain boundaries, or the grain boundaries.

The heat treatment method according to the invention is particularly suitable for use with nickel-based superalloys for the production of large single-crystal components, in particular blades for gas turbines.

Other advantageous variants of the invention are described in the claims.

BRIEF DESCRIPTION OF THE DRAWINGS

Exemplary embodiments of the invention are represented in the drawings, in which.

DETAILED DESCRIPTION

The invention will be explained in more detail below with the aid of exemplary embodiments and the drawings.

The nickel-based superalloys CMSX4 and SX MC2 known from the prior art, as well as the nickel-based superalloys SX MK4HC and SX MD2 microalloyed with the grain-boundary strengthening elements carbon and boron, with the chemical compositions indicated in Table 1 (data in wt. %) were studied:

TABLE 1

Chemical compositions of the alloys studied

| | CMSX4 | SX MC2 | SX MK4HC | SX MD2 |
|---|---|---|---|---|
| Ni | remainder | remainder | remainder | remainder |
| Cr | 6.5 | 8.0 | 6.5 | 8.0 |
| Co | 9.0 | 5.0 | 9.7 | 5.1 |
| Mo | 0.6 | 2.0 | 0.6 | 2.0 |
| W | 6.0 | 8.0 | 6.4 | 8.1 |
| Ta | 6.5 | 6.0 | 6.5 | 6.0 |
| Al | 5.6 | 5.0 | 5.6 | 5.0 |
| Ti | 1.0 | 1.5 | 1.0 | 1.3 |
| Hf | 0.1 | | 0.2 | 0.12 |
| Re | 3.0 | | 3.0 | |
| Si | | | | 0.12 |
| C | | | 350 ppm | 225 ppm |
| B | | | 70 ppm | 70 ppm |

These alloys are nickel-based superalloys for single-crystal components and are used for the production of gas turbine components. They belong to the first type of nickel-based superalloys as described above, i.e. they are fully heat treatable and with solution annealing above a temperature T1, for example at 1320° C. for CMSX4, the lattice is fully solution annealed i.e. the precipitates are entirely dissolved in the matrix. This applies for the standard heat treatments shown in FIGS. 2, 4, 6 and 8.

Figure 1:
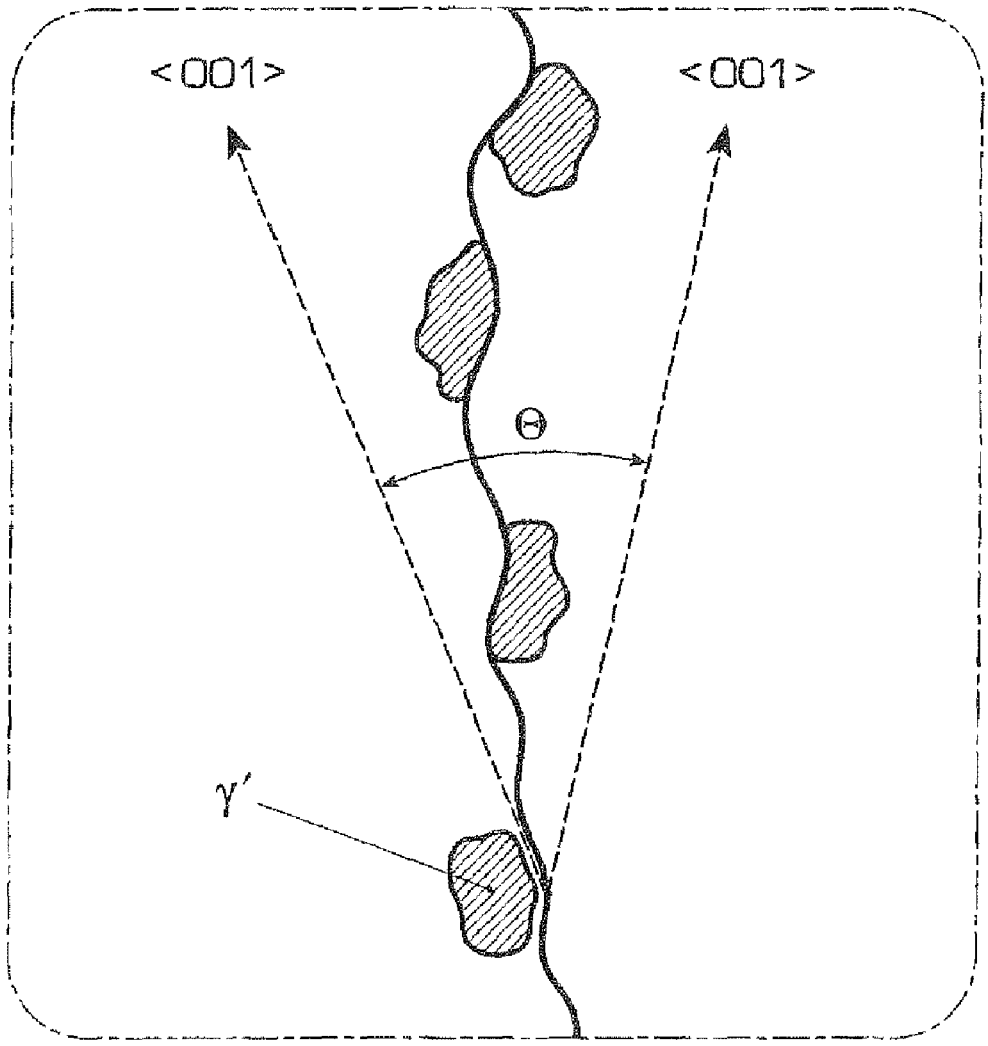
FIG. 1 shows a schematic structural image in the region of a small-angle grain boundary with undissolved γ' phase.

If the alloy CMSX4 is now subjected to the heat treatment method according to the invention and is only partially solution annealed in a controlled way at a temperature T2<T1 in a first step, here at 1280° C./8 h/cooling with an argon blower (see FIG. 2) and a two-stage ageing treatment is carried out at respectively lower temperatures in a second step, here 1140° C./4 h/cooling with an argon blower and 870° C./20 h/air cooling, then an increase in the disorientation of the small-angle grain boundaries is thereby achieved as represented schematically in FIG. 1. The undissolved γ' phase strengthens the small-angle grain boundaries so that a new strengthening mechanism is created, compared with the strengthening mechanism which is achieved by the addition of B or C. Best properties are obtained when there are 5-10% of γ' residual eutectic.

Figure 2:
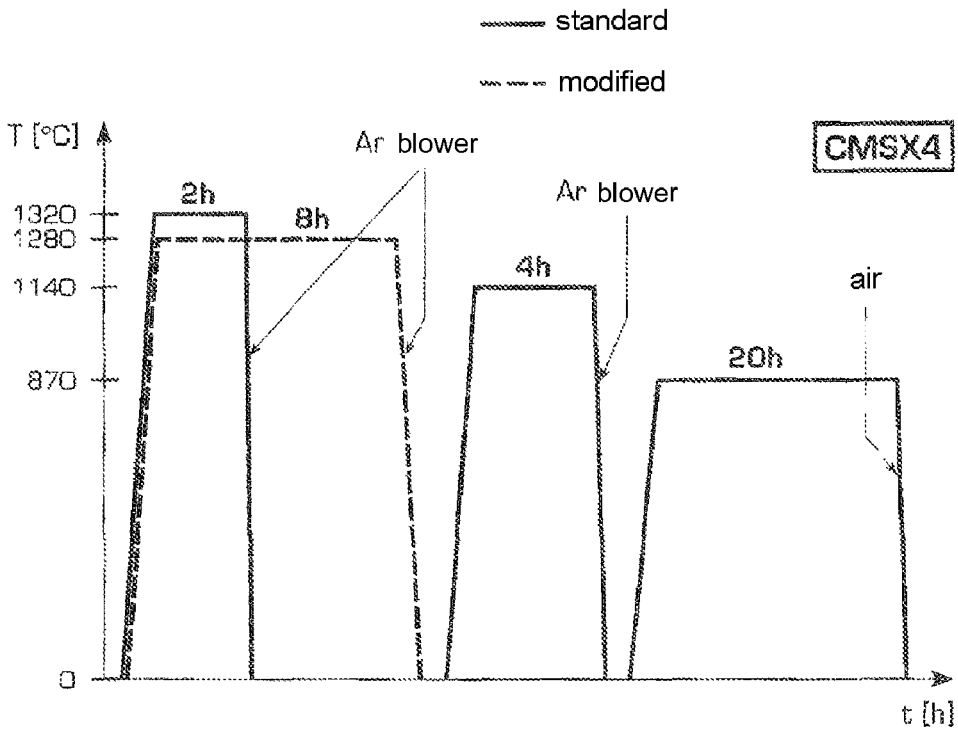
FIG. 2 shows a time-temperature diagram for the alloy CMSX4 with standard heat treatment and heat treatment according to the invention.
Figure 3:
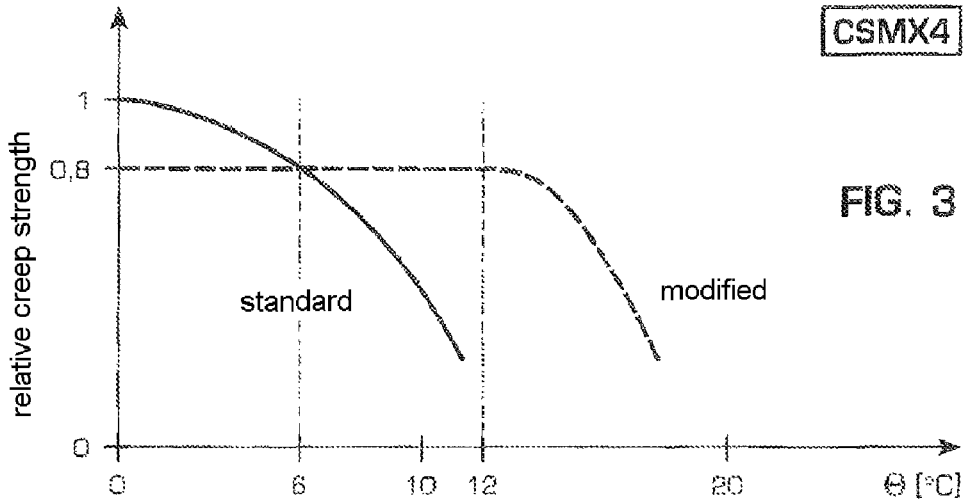
FIG. 3 shows the dependency of the high-temperature endurance (relative units) on the size of the disorientation of the small-angle grain boundaries/grain boundaries for the two heat treatment methods according to FIG. 2.

FIG. 3 represents the dependency of the high-temperature endurance (relative units) on the size of the disorientation of the small-angle grain boundaries/grain boundaries for the two heat treatment methods according to FIG. 2 for the alloy CMSX4. It can be seen that after the standard heat treatment (full solution annealing) the creep strength has already decreased to about 80% compared with a defect-free component beyond about 6° of disorientation, while about 12° of disorientation are still permissible after the heat treatment according to the invention.

Figure 4:
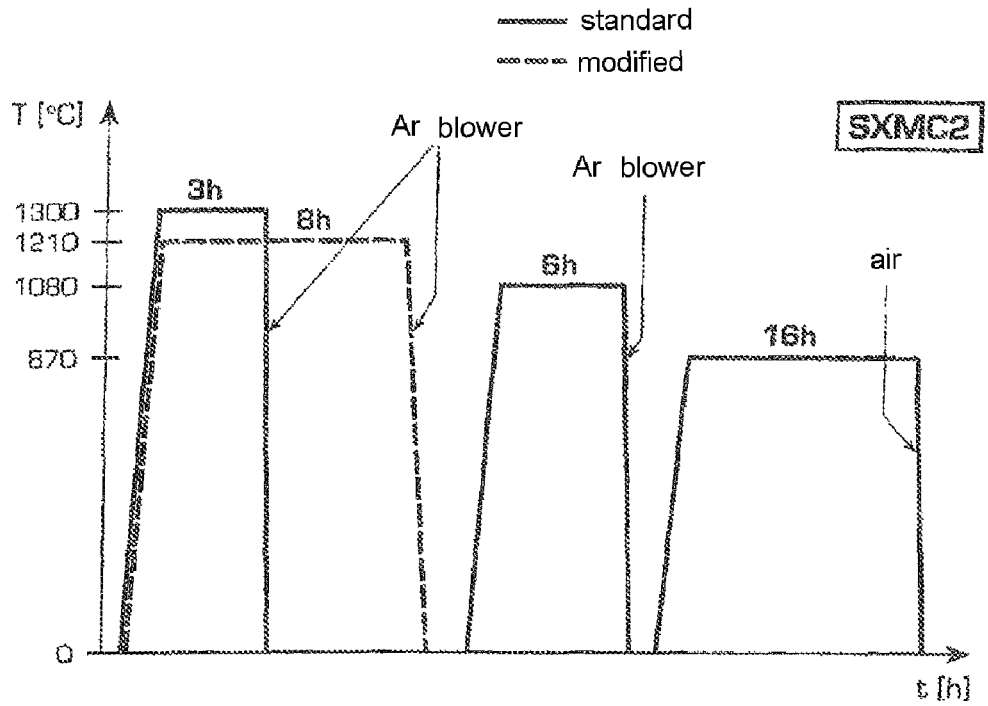
FIG. 4 shows a time-temperature diagram for the alloy SX MC2 with standard heat treatment and heat treatment according to the invention.
Figure 5:
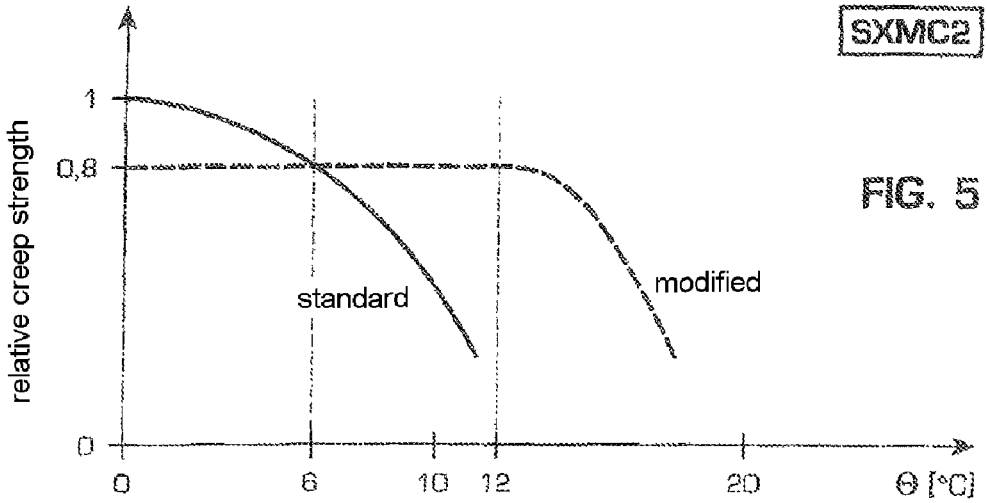
FIG. 5 shows the dependency of the high-temperature endurance (relative units) on the size of the disorientation of the small-angle grain boundaries/grain boundaries for the two heat treatment methods according to FIG. 4.

A similar observation can be made for the second exemplary embodiment (FIG. 4 and FIG. 5).

The alloy SX MC2 was heat treated according to the invention with a first step (partial solution annealing at 1210° C./8 h/rapid argon cooling with blower) and a second step (two-stage annealing at 1080° C./6 h/rapid argon cooling with blower and then 870° C./16 h/air cooling). The endurance was subsequently determined and the results were compared with the results after standard heat treatment (full solution annealing at 1300° C.). The relative creep strength already showed a significant drop with disorientation of more than 6° after the standard heat treatment, while this did not occur until a disorientation angle of about 12° after the heat treatment according to the invention.

The consequence of this high tolerance with respect to small-angle grain boundaries is a high casting yield for large cast components, for example single-crystal rotor blades or single-crystal guide vanes of turbine heat engines. A high casting yield advantageously leads to an increase in effectiveness without additional outlay.

Figure 6:
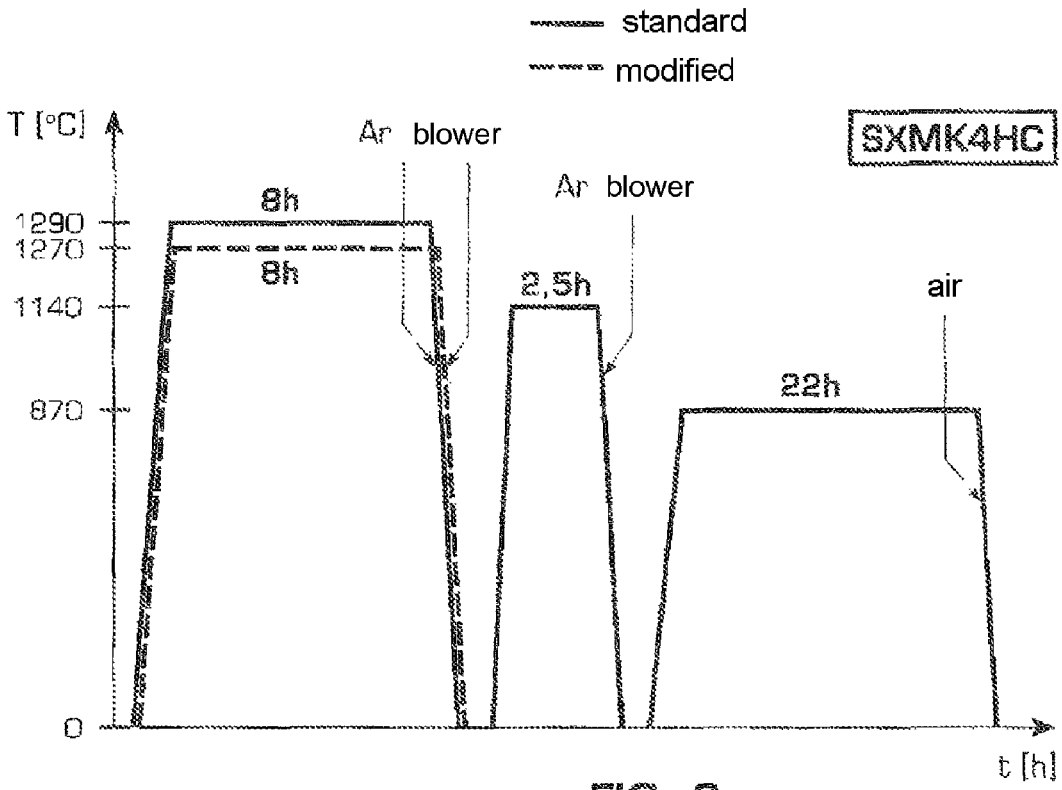
FIG. 6 shows a time-temperature diagram for the alloy SX MK4HC with standard heat treatment and heat treatment according to the invention.
Figure 7:
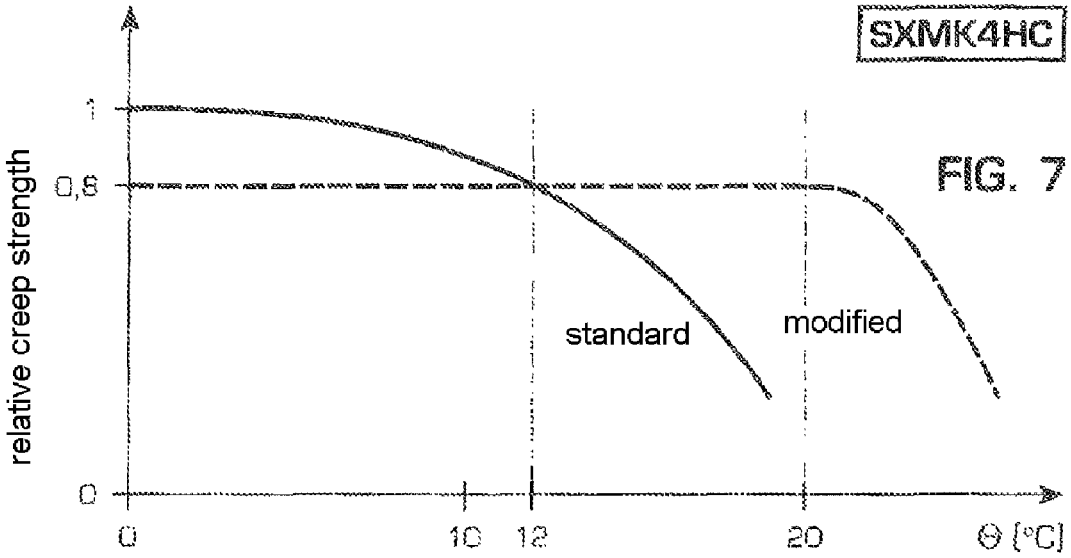
FIG. 7 shows the dependency of the high-temperature endurance (relative units) on the size of the disorientation of the small-angle grain boundaries/grain boundaries for the two heat treatment methods according to FIG. 6.

FIGS. 6 and 7 show another exemplary embodiment of the invention.

In a time-temperature diagram for the single-crystal alloy MK4HC in FIG. 6, the standard solution annealing treatment (1290° C./8 h/rapid argon cooling with blower) with subsequent two-stage annealing treatment (1140° C./2.5 h/rapid argon cooling with blower and 870° C./22 h/air cooling) is compared with the modified heat treatment according to the invention (partial solution annealing treatment at 1270° C./8 h/rapid argon cooling with blower, then two-stage annealing with the same parameters as for the standard heat treatment).

In FIG. 7, the dependency of the high-temperature endurance (relative units) on the size of the disorientation of the small-angle grain boundaries/grain boundaries is represented for the two heat treatment methods according to FIG. 6 for the alloy SXMK4HC. It can be seen that after the standard heat treatment (full solution annealing) the creep strength has already decreased to about 80% compared with a defect-free component beyond about 12° of disorientation, while this decrease does not occur until about 20° disorientation of the grain boundaries after the heat treatment according to the invention. Here again, about 20° of disorientation is therefore still permissible. This enhanced grain-boundary strengthening is obtained on the one hand by the additionally alloyed grain-boundary strengtheners C and B, and on the other hand by the residual eutectic (5-10% γ') present owing to the incomplete solution annealing process.

Figure 8:
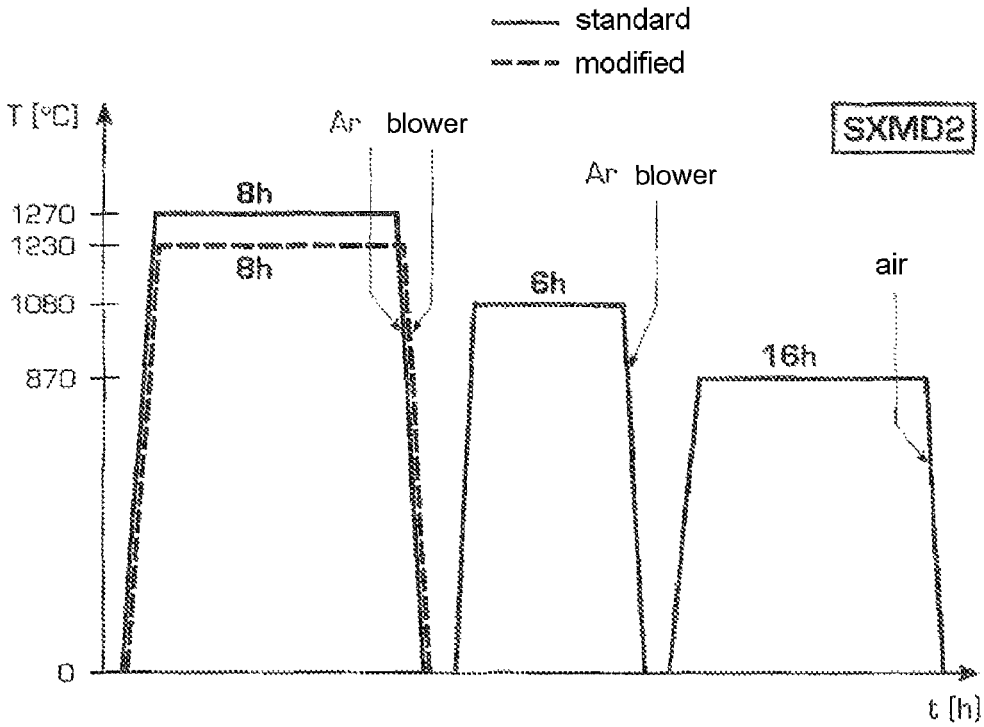
FIG. 8 shows a time-temperature diagram for the alloy SX MD2 with standard heat treatment and heat treatment according to the invention.
Figure 9:
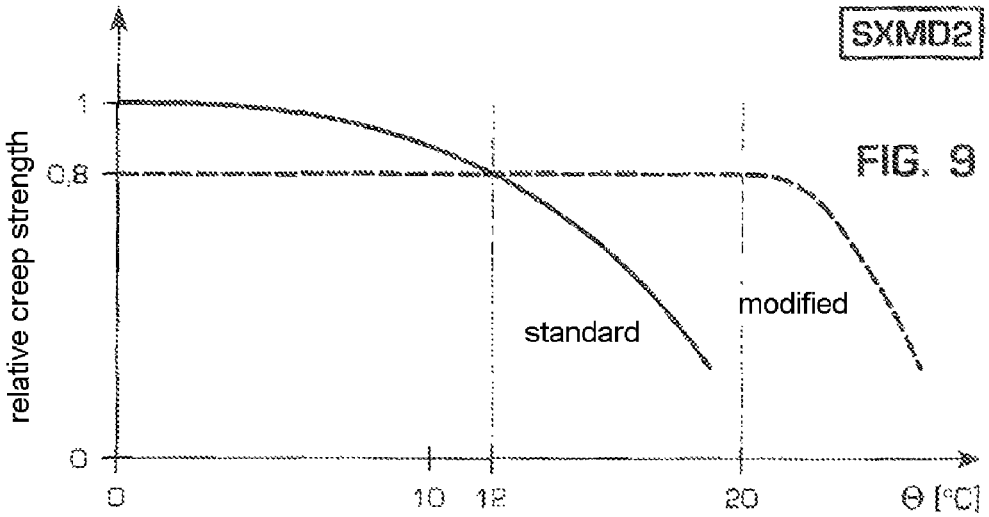
FIG. 9 shows the dependency of the high-temperature endurance (relative units) on the size of the disorientation of the small-angle grain boundaries/grain boundaries for the two heat treatment methods according to FIG. 8.

This tendency is represented in FIGS. 8 and 9 for the alloy SX MD2. In a time-temperature diagram in FIG. 8, the standard heat treatment and the heat treatment according to the invention is in turn represented for the alloy SX MD2, the partial solution annealing treatment according to the invention being carried out at 1230° C./8 h/rapid argon cooling with a blower, while the standard solution annealing takes place at 1270° C./8 h/rapid argon cooling with a blower. The subsequent two-stage annealing process is the same for both treatments:

1080° C./6 h/rapid argon cooling with a blower and
870° C./16 h/air cooling.

In FIG. 9 the dependency of the high-temperature endurance (relative units) on the size of the disorientation of the small-angle grain boundaries/grain boundaries is in turn represented for the two heat treatment methods according to FIG. 8 for the alloy SXMD2. As before in the previous exemplary embodiment, here again the creep strength has decreased to about 80% compared with a defect-free component beyond about 12° disorientation of the grain boundaries, while this decrease does not occur until about 20° disorientation of the grain boundaries after the heat treatment according to the invention. Here again, therefore, disorientations of about 20° are still permissible. This enhanced grain-boundary strengthening is obtained in this alloy on the one hand by the additionally alloyed grain-boundary strengtheners C and B, and on the other hand by the residual eutectic (5-10% γ') present owing to the incomplete solution annealing process.

What is claimed is:

1. A heat treatment method of a nickel-based superalloy, which permits full solution annealing at a temperature T1, the method comprising:

partially solution annealing the superalloy in a controlled manner at a temperature T2 <T1 in a first step so as to obtain 5-10% of undissolved γ' phase in a residual eutectic; and performing a two-stage ageing treatment at respectively lower temperatures in a second step, wherein in the nickel-based superalloy has the following chemical composition (data in wt.%): 5.1 Co, 8.0 Cr, 2.0 Mo, 8.1 W, 5.0 Al, 1.3 Ti, 6.0 Ta, 0.12 Hf, 0.12 Si, 225 ppm C, 70 ppm B, remainder Ni, wherein the partial solution annealing of the first step includes annealing at 1230° C./8h/ Ar cooling with a blower and wherein the two-stage ageing treatment of the second step includes annealing at 1080° C./6h/ Ar cooling with a blower and subsequently 870° C./16h/air cooling.

* * * * *